US006371842B1

(12) United States Patent
Romero

(10) Patent No.: US 6,371,842 B1
(45) Date of Patent: Apr. 16, 2002

(54) PATTERNED ABRADING ARTICLES AND METHODS OF MAKING AND USING SAME

(75) Inventor: Vincent D. Romero, St. Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by five years.

(21) Appl. No.: 08/495,297

(22) Filed: Jun. 28, 1995

Related U.S. Application Data

(63) Continuation of application No. 08/078,579, filed on Jun. 17, 1993, now abandoned.

(51) Int. Cl.[7] ..... B23F 21/03; B23F 21/23
(52) U.S. Cl. ..... 451/540; 451/548
(58) Field of Search ..... 451/548, 550, 451/549, 551, 540

(56) References Cited

U.S. PATENT DOCUMENTS

| | | | | | |
|---|---|---|---|---|---|
| 970,618 | A | * | 9/1910 | Gardner | 51/209 R |
| 1,854,508 | A | * | 4/1932 | Drake | 51/209 S |
| 2,410,506 | A | | 11/1946 | Kirchner et al. | |
| 2,712,987 | A | | 7/1955 | Storrs et al. | |
| 2,907,146 | A | | 10/1959 | Dyar | |
| 3,048,482 | A | | 8/1962 | Hurst | |
| 3,991,527 | A | | 11/1976 | Maran | 51/397 |
| 4,314,827 | A | | 2/1982 | Leitheiser et al. | |
| 4,525,177 | A | | 6/1985 | Grimes et al. | |
| 4,554,765 | A | | 11/1985 | Grimes et al. | |
| 4,652,275 | A | | 3/1987 | Bloecher et al. | |
| 4,653,236 | A | | 3/1987 | Grimes et al. | |
| 4,744,802 | A | | 5/1988 | Schwabel | |
| 4,770,671 | A | | 9/1988 | Monroe et al. | |
| 4,881,951 | A | | 11/1989 | Wood et al. | |
| 4,903,440 | A | | 2/1990 | Larson et al. | |
| 4,906,523 | A | | 3/1990 | Bilkadi et al. | |
| 5,015,266 | A | | 5/1991 | Yamamoto | |
| 5,142,829 | A | | 9/1992 | Germain | |
| 5,174,795 | A | | 12/1992 | Wiand | 51/295 |
| 5,197,249 | A | * | 3/1993 | Wiand | 51/395 |
| 5,201,916 | A | | 4/1993 | Berg et al. | |
| 5,213,591 | A | | 5/1993 | Celikkaya et al. | |
| 5,287,662 | A | * | 2/1994 | Weis et al. | 51/395 |
| 5,316,812 | A | | 5/1994 | Stout et al. | 428/64 |

FOREIGN PATENT DOCUMENTS

| | | | |
|---|---|---|---|
| DE | 274184 A1 | 12/1989 | B24D/11/00 |
| EP | 0 111 795 A3 | 11/1983 | B24D/3/00 |

* cited by examiner

*Primary Examiner*—Derris H. Banks
(74) *Attorney, Agent, or Firm*—Gregory D. Allen

(57) ABSTRACT

An abrasive article having a patterned abrasive surface is provided. In accordance with the present invention, the article comprises a substrate having a first side. A plurality of raised portions are positioned on the first side of the substrate with the raised portions defining recessed areas between each raised portion. A first adhesive layer is applied to the raised portions and an abrasive material is deposited onto the first adhesive layer thereby coating the raised portions of the substrate to form an abrasive coating with the recessed areas remaining free of the abrasive material.

27 Claims, 2 Drawing Sheets

PATTERNED ABRADING ARTICLES AND METHODS OF MAKING AND USING SAME

This application is a continuation of U.S. application Ser. No. 08/078,579, filed Jun. 17, 1993, now abandoned.

BACKGROUND OF THE INVENTION

The present invention relates to patterned abrading articles and, in particular, it relates to patterned abrading articles comprising a substrate having raised portions with an abrasive material deposited on the raised portions.

Coated abrasive articles generally contain an abrasive material, typically in the form of abrasive grains, bonded to a backing by means of one or more adhesive layers. Abrasive articles can be used for sanding, grinding or polishing various surfaces of, for example, steel and other metals, wood, wood-like laminates, plastic, fiberglass, leather or ceramics.

Many abrasive articles are used as discs, in grinding assemblies. Typical abrasive sanding or grinding assemblies include a support pad made from a resilient and reinforced material such as rubber or plastic, an abrasive disc, which is typically frictionally mounted on the backup pad and a rotatable shaft and cap for mounting the abrasive disc and backup pad by pressure applied to the disc upon screwing the cap into the shaft so that the disc is squeezed against the backup pad. In use, the shaft of the assembly is rotated and the abrasive coated surface of the disc presses against a workpiece.

In general, there are two methods of manufacturing coated abrasive discs. The first method is to manufacture the abrasive disc from a coated abrasive web produced from known techniques, e.g., coating at least one binder and the abrasive grains on a cloth, vulcanized fiber, paper, or similar backing. The cured abrasive web is then converted, via die cutting, into substantially circular discs.

The second type of abrasive disc manufacture is to commence with a backing already in the desired final form, i.e., circular with desired diameter and optional central hole or holes. This disc backing is then coated with a first binder, commonly referred to as make coating. Abrasive grains are then embedded into the make coating and the make coating is exposed to conditions sufficient to solidify the make coating to a degree to adhere the abrasive grains to the backing. A second binder is then coated over the abrasive grains and then solidified. Another method is to coat the backing with a slurry of resin and mineral. Typical backings used include vulcanized rubber, vulcanized fiber, and metal (aluminum or steel).

Both methods of manufacture set forth above are widely used for the production of abrasive discs, although problems are inherent of each. The discs punched from a web usually have a fairly thin backing, typically about 100 to 2500 micrometers. A backing of such thickness easily rips and tears, and can crease and pucker easily. Web-originated discs have a tendency to curl or cup with age if not stored under ideal humidity conditions. Unfortunately, if a thicker backing is used to attempt to eliminate the thin backing, cutting or punching the discs becomes difficult because of the thicker backing. In addition, thicker and tougher backings create more dulling of the cutting blades.

Abrasive discs that are produced by coating the preformed backing are usually singularly coated via a knife coater or graveure rolls, or sometimes even manually with a paintbrush. Unfortunately, as the coating meets the leading edge of the circular backing, the coating means may jump a bit leaving an undesirable high lip of the coating material on the edge of the disc. This lip is a high point on the abrasive disc which can cause undesirable scratches and gouges in the workpiece being abraded by the disc. A means of avoiding having to coat the edge of the disc thereby preventing the lip from forming is to either mask off the edge area, or lower it so that it is not coated. Such a procedure is not desirable due to increased labor and production costs associated with maintaining a uniform thickness coating.

SUMMARY OF THE INVENTION

The present invention is a coated abrasive article having a patterned abrasive surface. The article comprises a disc-shaped thermoplastic substrate having a first side. A plurality of raised portions are positioned on the first side of the substrate with recessed areas defined between each raised portion. A first adhesive layer is applied to the raised portions. Furthermore, an abrasive material is deposited into the first adhesive layer thereby coating the raised portions of the binder material to form an abrasive coating with the recessed areas remaining substantially free of abrasive material deposit. These raised portions result in a substrate that has a reduced tendency to form a raised lip during the manufacture of the coated abrasive.

DESCRIPTION OF PREFERRED EMBODIMENTS

Figure 1:
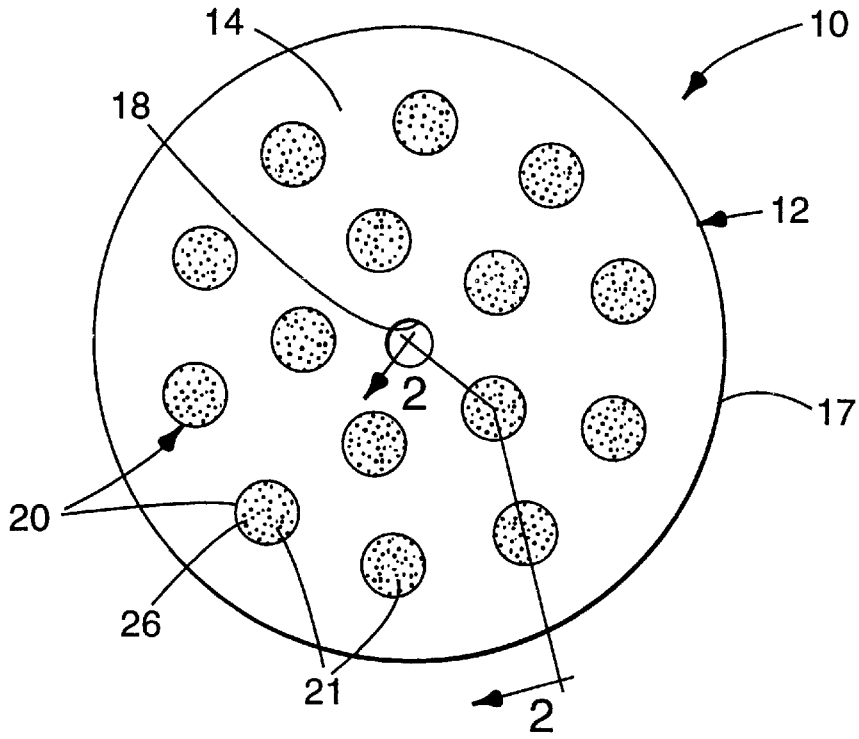
FIG. 1 is a plan view of an abrasive article having a substrate with raised portions in accordance with the present invention.

FIG. 1 illustrates a plan view of an abrasive disc, designated generally at 10, in accordance with the present invention, for grinding, sanding and polishing various work pieces (not shown). The disc 10 includes a substantially circular substrate 12 preferably formed by injection molding of a thermoplastic binder material. While the substrate 12 of the present invention has been described as comprising a thermoplastic binder material, any resilient and reinforced material such as rubber or other plastics is within the scope of the present invention. The substrate is a hardened structure that preferably comprises a thermoplastic material and a fibrous material.

Figure 2:
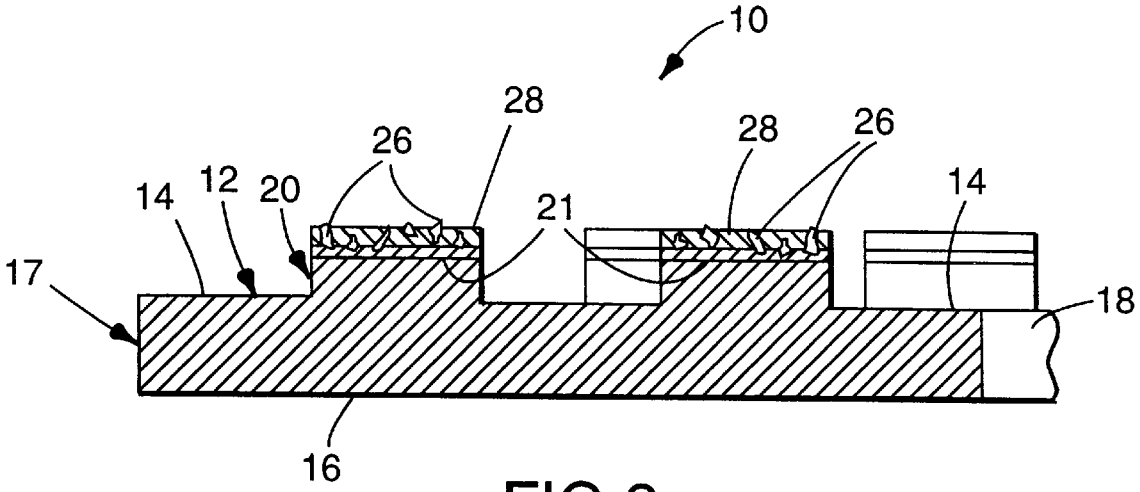
FIG. 2 is a sectional view along the line 2—2 of the abrasive article of FIG. 1.

The substrate 12 includes a recessed portion or area 14, a back side or non-grinding side 16 (as illustrated in FIG. 2) and a periphery 17. An aperture 18 extending through the approximate center of the substrate receives a suitable tool (not shown) for mounting the substrate 12 on suitable grinding machinery (not shown).

The substrate 12 preferably has a diameter ranging from about 5 to about of 30 centimeters (cm), more preferably about 17 cm, and the central aperture diameter preferably ranges from about 1.27 cm to about 2.54 cm. The thickness of the substrate (not including the raised portions) typically and preferably ranges from about 100 to about 2500 micrometers. It should be noted, however, that diameters, thicknesses, and apertures less than or greater than these preferred ranges, are also within the scope of the present invention. Substrate 12 is preferably circular, however, it is within the scope of this invention to have the substrate in the shape of a rectangle, square, hexagon, octagon, oval, and the like. The disc may also have a center portion with arms projecting out from the center portion. A structure similar to the latter is described in assignee's U.S. Pat. No. 5,142,829, incorporated herein by reference for the purpose of that disclosure.

A plurality of raised portions 20 having a top surface 21 are positioned between the recessed areas 14 of the substrate 12. Raised portions 20 are preferably made from the same material as the substrate 12 and formed on the substrate 12 when the substrate 12 is formed during the injection molding process. However, it is within the scope of the present invention to use different materials for the raised portions 20 and/or to attach separate raised portions 20 to the substrate 12 by adhesive or other means.

The raised portions 20 can be formed in a variety of geometric shapes including circles, ellipses, rectangles, triangles, lines, swirls or any irregular or non-defined shape. The dimensions, i.e., the lengths and widths, of the raised portions are preferably between approximately 0.1 centimeter and approximately 5.0 centimeters. In the case of a raised portion 20 having a geometric shape of a line 33 or a swirl 32, the length of the line 33 or the swirl 32 is approximately the radius of the substrate 12 with the swirl 32 having a width which varies at a narrowest point of approximately 0.1 centimeter to a wider point of approximately 5 centimeters. The height of the raised portions 20 from the surface of the recessed area 14 is between approximately 0.05 millimeter (50 micrometers) to about 10 millimeters. Preferably the height of the raised portions 20 is between approximately 0.1 millimeter (100 micrometers) to about 5 millimeters.

Figure 3:
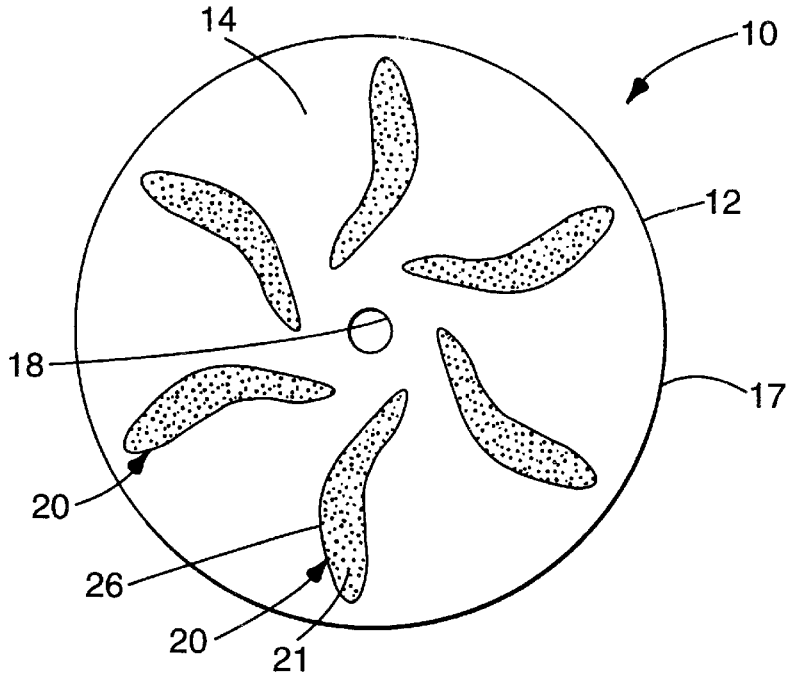
FIG. 3 is a plan view of another embodiment of the present invention.
Figure 4:
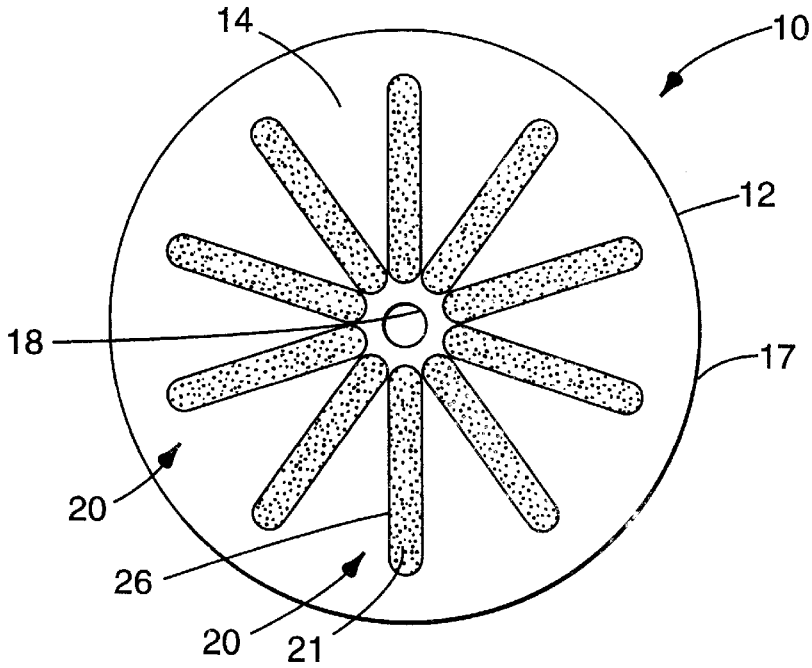
FIG. 4 is a plan view of yet another embodiment of the present invention.

The raised portions 20 are arranged on the substrate 12 in any manner between recessed areas 14. However, in the preferred embodiment, the raised portions 20 are arranged as illustrated in FIG. 1, in concentric circles between the aperture 18 and the periphery 17 or, as illustrated in FIG. 3, in radial swirls, or as illustrated in FIG. 4, in radial lines, all extending from a point approximate the aperture 18 to a point near the periphery 17 of the substrate 12.

The substrate of the invention may be made by any one of a variety of methods. The most preferred method is to inject a thermoplastic material into a mold having recessed regions, the recessed regions accepting thermoplastic material and thus form the raised areas of the substrate. A suitable mold release may be required for this procedure, as is known in the art. IN this method, the mold would have the specified configuration and dimensions to form a unitary construction with the raised portions being unitary with the flat or recessed areas of the substrate. An alternative method is to first form a flat substrate either by extrusion of a thermoplastic material or by injection molding of a thermoplastic material. The raised portions are then bonded to the flat substrate by a sutiable adhesive. This results also in a substrate having raised portions and recessed areas. Another alternative is to emboss a flat substrate to form the raised and recessed areas. A thermoplastic material is first heated to a softened state and then pressed against a patterned tool, removed therefrom, and then cooled to reharden the thermoplastic material.

According to the present invention, the area comprised of the top surfaces 21 of the raised portions 20 comprises the grinding area of the disc 10. The substrate already has the desired dimensions and shape for the end product application. Each substrate is individually coated. Recessed areas 14 do not participate in the grinding. As illustrated in FIG. 2, a first adhesive layer 24 formed from a resinous adhesive is applied to the top surfaces 21 of the substrate 12. The first adhesive layer, sometimes referred to as a make coating, may be applied by any one of a variety of methods, including roll coating, die coating, screen printing, gravure coating, knife coating, spray coating and the like. This coating process should result in the adhesive being applied only to the raised portions of the substrate.

An abrasive material or grain 26 is then applied to the adhesive-coated top surfaces 21 of the raised portions 20 while the recessed areas 14 between the raised portions 20 remain free from abrasive material deposits. The abrasive material may be applied by drop coating, electrostatic precitation, or other like means. The resulting construction is then exposed to conditions to at least partially solidify the first adhesive coating to a degree that the first adhesive layer will hold the abrasive grains to the substrate raised portions. Next, a second adhesive layer is appliedover the abrasive grains and first adhesive layer. The resulting construction is exposed to conditions sufficient to solidify both the first and second adhesives. In oder to at least partially or fully solidify the adhesive layers, the construction can be exposed to either thermal energy, radiation energy (elctron beam, ultraviolet or visible light) or combinations thereof, depending upon the chemical nature of the adhesive layer. Since the substrate is coated individually, the raised portions provide a means for a uniform coating to be formed on a substrate, and minimize the formations of excessive adhesive edge (i.e., "lip") buildup.

The average particle sized of the abrasive grain 26 for advantageous applications of the present invention is at least approximately 50 micrometers and and may range up to about 2500 micrometers. The abrasive grains may have a uniform, predetermined shape such as abrasive grains disclosed in U.S. Pat. No. 5,201,916, also incoporated herein by reference. The abrasive material 26 can also be oriented in certain patterns, or it can be applied to the top surface 21 of the raised portions without and pattern orientation. The abrasive grains preferably have a Moh hardness of 7 or greater, and non-abrasive (Moh hardness less than 7) diluent grains may be added therewith.

Following the application of the abrasive material 26, a size resin 28 is applied over the abrasive material 26 and first adhesive layer. (FIG. 2 only shows the size resin applied to the raised portions. It is also possible to apply the size resin 28 over the entire exposed surface of the substrate, i.e., including both raised and recessed areas.) The size resin 28 is preferably comprised of filled phenolic resin but could comprise the same material as the make coat 24 or other coating which is compatible with the thermoplastic material of the substrate 12.

Preferred hardened backing compositions withstand a temperature of at least about 200° C., and a pressure of at least about 7 kg/cm$^2$, preferably at least about 13.4 kg/cm$^2$, at the abrading interface of a workpiece. That is, the preferred moldable thermoplastic materials have a melting point of at least about 200° C. Additionally, the melting temperature of the tough, heat resistant, thermoplastic material is preferably sufficiently lower, i.e., at least about 25° C. lower, than the melting temperature of the fibrous reinforcing material. In this way, the reinforcing material is not adversely affected during the molding of the thermoplastic binder. Furthermore, the thermoplastic material in the backing is sufficiently compatible with the material used in the adhesive layers such that the backing does not deteriorate, and such that there is effective adherence of the abrasive material. Preferred thermoplastic materials are also generally insoluble in an aqueous environment, at least because of the desire to use the coated abrasive articles of the present invention on wet surfaces.

Examples of thermoplastic materials suitable for preparations of backings in articles according to the present invention include polycarbonates, polyetherimides, polyesters, polysulfones, polystyrenes, acrylonitrile-butadiene-styrene block copolymers, acetal polymers, polyamides, or combinations thereof. Of this list, polyamides and polyesters are preferred. Polyamide materials are the most preferred thermoplastic binder materials, at least because they are inherently tough and heat resistant, typically provide good adhesion to the preferred adhesive resins without priming, and are relatively inexpensive.

If the thermoplastic binder material from which the backing is formed is a polycarbonate, polyetherimide, polyester, polysulfone, or polystyrene material, use of a primer may be preferred to enhance the adhesion between the backing and the make coat. The term "primer" as used in this context is meant to include both mechanical and chemical type primers or priming processes. Examples of mechanical priming processes include, but are not limited to, corona treatment and scuffing, both of which increase the surface area of the backing. An example of a preferred chemical primer is a colloidal dispersion of, for example, polyurethane, acetone, isopropanol, water, and a colloidal oxide of silicon, as taught by U.S. Pat. No. 4,906,523, which is incorporated herein by reference.

The most preferred thermoplastic material from which the backing of the present invention is formed is a polyamide resin material, which is characterized by having an amide group, i.e., —C(O)NH—. Various types of polyamide resin materials, i.e., nylons, can be used, such as nylon 6/6 or nylon 6. Of these, nylon 6 is most preferred if a phenolic-based make coat is employed. (The terms "make" coating and "size" coating are well known in the art, and no further description is deemed necessary.) This is because excellent adhesion can be obtained between nylon 6 and phenolic-based adhesives. Polymeric backings of this nature are described in Stout, U.S. Pat. No. 5,316,812, issued on May 31, 1994, which is assigned to the assignee of the present application and which is hereby incorporated herein by reference, describes in detail the actual construction and manufacture of a substrate from a thermoplastic binder material.

Besides the thermoplastic binder material, the backing of the invention preferably includes an effective amount of a fibrous reinforcing material. Herein, an "effective amount" of a fibrous material is a sufficient amount to impart at least improvement in the physical characteristics of the hardened backing, i.e., heat resistance, toughness, flexibility, stiffness, shape control, adhesion, etc., but not so much fibrous reinforcing material as to give rise to any significant number of voids and detrimentally affect the structural integrity of the backing. Preferably, the amount of the fibrous reinforcing material in the backing is within a range of about 1–40%, more preferably within a range of about 5–35%, and most preferably within a range of about 15–30%, based upon the weight of the backing.

The fibrous material, if used, can be in the form of individual fibers or fibrous strands, or in the form of a fiber mat or web. Preferably, the reinforcing material is in the form of individual fibers or fibrous strands for advantageous manufacture. Fibers are typically defined as fine thread-like pieces with an aspect ratio of at least about 100:1. The aspect ratio of a fiber is the ratio of the longer dimension of the fiber to the shorter dimension. The mat or web can be either in a woven or nonwoven matrix form. A nonwoven mat is a matrix of a random distribution of fibers made by bonding or entangling fibers by mechanical, thermal, or chemical means.

Examples of useful reinforcing fibers in applications of the present invention include metallic fibers or nonmetallic fibers. The nonmetallic fibers include glass fibers, carbon fibers, mineral fibers, synthetic or natural fibers formed of heat resistant organic materials, or fibers made from ceramic materials. Preferred fibers for applications of the present invention include nonmetallic fibers, and more preferred fibers include heat resistant organic fibers, glass fibers, or ceramic fibers.

By "heat resistant" organic fibers, it is meant that useable organic fibers must be resistant to melting, or otherwise breaking down, under the conditions of manufacture and use of the coated abrasive backings of the present invention. Examples of useful natural organic fibers include wool, silk, cotton, or cellulose. Examples of useful synthetic organic fibers include polyvinyl alcohol fibers, polyester fibers, rayon fibers, polyamide fibers, acrylic fibers, aramid fibers, or phenolic fibers. The preferred organic fiber for applications of the present invention is aramid fiber. Such fiber is commercially available from the Dupont Co., Wilmington, Del. under the trade names of "Kevlar" and "Nomex."

The most preferred reinforcing fibers for applications of the present invention are glass fibers, at least because they impart desirable characteristics to the coated abrasive articles and are relatively inexpensive. Furthermore, suitable interfacial binding agents exist to enhance adhesion of glass fibers to thermoplastic materials. Glass fibers are typically classified using a letter grade. For example, E glass (for electrical) and S glass (for strength). Letter codes also designate diameter ranges, for example, size "D" represents a filament of diameter of about 6 micrometers and size "G" represents a filament of diameter of about 10 micrometers. Useful grades of glass fibers include both E glass and S glass of filament designations D through U. Preferred grades of glass fibers include E glass of filament designation "G" and S glass of filament designation "G." Commercially available glass fibers are available from Specialty Glass Inc., Oldsmar, Fla.; Owens-Corning Fiberglass Corp., Toledo, Ohio; and Mo-Sci Corporation, Rolla, Mo.

If glass fibers are used, it is preferred that the glass fibers are accompanied by an interfacial binding agent, i.e., a coupling agent, such as a silane coupling agent, to improve the adhesion to the thermo-plastic material. Examples of silane coupling agents include "Z-6020" and "Z-6040," available from Dow Corning Corp., Midland, Mich.

Advantages can be obtained through use of fiber materials of a length as short as 100 micrometers, or as long as needed for one continuous fiber. Preferably, the length of the fiber will range from about 0.5 mm to about 50 mm, more preferably from about 1 mm to about 25 mm, and most preferably from about 1.5 mm to about 10 mm. The reinforcing fiber denier, i.e., degree of fineness, for preferred fibers ranges from about 1 to about 5000 denier, typically between about 1 and about 1000 denier. More preferably, the fiber denier will be between about 5 and about 300, and most preferably between about 5 and about 200. It is understood that the denier is strongly influenced by the particular type of reinforcing fiber employed.

The reinforcing fiber is preferably distributed throughout the thermoplastic material, i.e., throughout the body of the backing, rather than merely embedded in the surface of the thermoplastic material. This is for the purpose of imparting improved strength and wear characteristics throughout the body of the backing. A construction wherein the fibrous reinforcing material is distributed throughout the thermoplastic binder material of the backing body can be made using either individual fibers or strands, or a fibrous mat or web structure of dimensions substantially equivalent to the dimensions of the finished backing. Although in this preferred embodiment distinct regions of the backing may not have fibrous reinforcing material therein, it is preferred that the fibrous reinforcing material be distributed substantially uniformly throughout the backing.

The fibrous reinforcing material can be oriented as desired for advantageous applications of the present invention. That is, the fibers can be randomly distributed, or they can be oriented to extend along a direction desired for imparting improved strength and wear characteristics. Typically, if orientation is desired, the fibers should generally extend transverse (±20°) to the direction across which a tear is to be avoided.

The backings of the present invention can further include an effective amount of a toughening agent. This will be preferred for certain applications. A primary purpose of the toughening agent is to increase the impact strength of the coated abrasive backing. By "an effective amount of a toughening agent" it is meant that the toughening agent is present in an amount to impart at least improvement in the backing toughness without it becoming too flexible. The backings of the present invention preferably include sufficient toughening agent to achieve the desirable impact test values listed above.

Typically, a preferred backing of the present invention will contain between about 1% and about 30% of the toughening agent, based upon the total weight of the backing. More preferably, the toughening agent, i.e., toughener, is present in an amount of about 5–15 wt-%. The amount of toughener present in a backing may vary depending upon the particular toughener employed. For example, the less elastomeric characteristics a toughening agent possesses, the larger quantity of the toughening agent may be required to impart desirable properties to the backings of the present invention.

Preferred toughening agents that impart desirable stiffness characteristics to the backing of the present invention include rubber-type polymers and plasticizers. Of these, the more preferred are rubber toughening agents, most preferably synthetic elastomers.

Examples of preferred toughening agents, i.e., rubber tougheners and plasticizers, include: toluenesulfonamide derivatives (such as a mixture of N-butyl- and N-ethyl-p-toluenesulfonamide, commercially available from Akzo Chemicals, Chicago, Ill., under the trade designation "Ketjenflex 8"); styrene butadiene copolymers; polyether backbone polyamides (commercially available from Atochem, Glen Rock, N.J., under the trade designation "Pebax"); rubber-polyamide copolymers (commercially available from DuPont, Wilmington, Del., under the trade designation "Zytel FN"); and functionalized triblock polymers of styrene-(ethylene butylene)-styrene (commercially available from Shell Chemical Co., Houston, Tex., under the trade designation "Kraton FG1901"); and mixtures of these materials. Of this group, rubber-polyamide copolymers and styrene-(ethylene butylene)-styrene triblock polymers are more preferred, at least because of the beneficial characteristics they impart to backings and the manufacturing process of the present invention.

Rubber-polyamide copolymers are the most preferred, at least because of the beneficial impact and grinding characteristics they impart to the backings of the present invention.

If the backing is made by injection molding, typically the toughener is added as a dry blend of toughener pellets with the other components. The process usually involves tumble-blending pellets of toughener with pellets of fiber-containing thermoplastic material. A more preferred method involves compounding the thermoplastic material, reinforcing fibers, and toughener together in a suitable extruder, pelletizing this blend, then feeding these prepared pellets into the injection molding machine. Commercial compositions of toughener and thermoplastic material are available, for example, under the designation "Ultramid" from BASF Corp., Parsippany, N.J. Specifically, "Ultramid B3ZG6" is a nylon resin containing a toughening agent and glass fibers that is useful in the present invention.

Useful resinous adhesives for use in make and size coatings are those that are compatible with the thermoplastic material of the backing, such as those disclosed in the previously incorporated by reference Stout application. The resinous adhesive is also tolerant of severe grinding conditions, as defined herein, when cured such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, or mixtures thereof.

Preferably, the thermosetting resin adhesive layers contain a phenolic resin, an aminoplast resin, or combinations thereof. The phenolic resin is preferably a resole phenolic resin. Examples of commercially available phenolic resins include "Varcum" from OxyChem, Inc., Dallas, Tex.; "Arofene" from Ashland Chemical Company, Columbus, Ohio; and "Bakelite" from Union Carbide, Danbury, Conn. A preferred aminoplast resin is one having at least 1.1 pendant $\alpha,\beta$-unsaturated carbonyl groups per molecule, which is made according to the disclosure of U.S. Pat. No. 4,903,440, which is incorporated herein by reference.

The make and size coatings can preferably contain other materials that are commonly utilized in abrasive articles. These materials, referred to as additives, include grinding aids, fillers, antistatic agents, coupling agents, wetting agents, dyes, pigments, plasticizers, release agents, or combinations thereof. One would not typically use more of these materials than needed for desired results. Fillers might also be used as additives in the first and second adhesive layers. For both economy and advantageous results, fillers are typically present in no more than an amount of about 50% for the make coat or about 70% for the size coat, based upon the weight of the adhesive. Examples of useful fillers include silicon compounds, such as silica flour, e.g., powdered silica of particle size 4–10 mm (available from Akzo Chemie America, Chicago, Ill.), and calcium salts, such as calcium carbonate and calcium metasilicate (available as "Wollastokup" and "Wollastonite" from Nyco Company, Willsboro, N.Y.).

Examples of abrasive material suitable for applications of the present invention include fused aluminum oxide, heat treated aluminum oxide, ceramic aluminum oxide, silicon carbide, alumina zirconia, garnet, diamond, cubic boron nitride, or mixtures thereof. The term "abrasive material" encompasses abrasive grains, agglomerates, or multi-grain abrasive granules. An example of such agglomerates is described in U.S. Pat. No. 4,652,275, which is incorporated herein by reference.

A preferred abrasive material is an alumina-based, i.e., aluminum oxide-based, abrasive grain. Useful aluminum oxide grains for applications of the present invention include fused aluminum oxides, heat treated aluminum oxides, and ceramic aluminum oxides. Examples of useful ceramic aluminum oxides are disclosed in U.S. Pat. Nos. 4,314,827, 4,744,802, 4,770,671, 4,881,951, and 5,213,591, all of which are incorporated herein by reference for the purpose of the disclosure of ceramic aluminum oxide abrasive grains.

EXAMPLES

General Preparation Procedure

As illustrated by the examples and test results below, the disc 10 according to the present invention increased the cutting rate as compared to other grinding discs. The discs for the Examples set forth below were constructed according to the following General Preparation Procedure unless otherwise specifically set forth in the actual Examples. The thermoplastic substrate that was formed by injection molding had a thickness of about 0.76 millimeter with a diameter of approximately 17.8 centimeters and a center hole having a diameter of approximately 2.2 centimeters. The substrate comprised, by weight, 74.7% nylon-6, 20.0% E-glass, 3.5% Noryl GTX-910, and 1.8% Kraton FG-1901X. If the substrate contained raised portions, the following procedure was used to produce the substrate. First, the entire front surface (i.e., the surface to be abrasive in nature) was coated with a laminating adhesive. The laminating adhesive was the same formulation as the make coat described herein below. The raised portions, which had been previously die cut from an injection molded flat substrate, were placed into the laminating adhesive. The raised portions were the same compositon as the flat substrate. The resulting substrate was exposed four times to ultraviolet light which operated at 300 watts/in at 15 ft/min (4.57 meters/minute) and then to a thermal cure of 2 hours at 88° C. The raised portions were then secured sufficiently to the flat substrate to apply the make coating, abrasive grains, and size coating. A make coat comprising, by weight, 29.6% resole phenolic resin, 24.2% bis-acrylamidomethyl ether, 0.8% of the photoinitiator known under the trade designation "Irgacure 651" (available from Ciba-Geigy Co.), 29.6% calcium carbonate, and 15.8% of calcium metasilicate known under the trade designation "Wollastokup", the total being about 82% solids, was manually coated onto the discs with a brush. Abrasive mineral was then electrostatically applied and oriented, then UV cured using a 300 watt/in lamp in four passes at 15 ft/min (4.57 meters/min) speed. After UV curing, a phenolic size resin, 76% solids, was coated over the abrasive mineral. The solvent for the make and size coatings was a 90:10 weight ratio of water and a glycol ether. The substrates were precured at about 88° C. for about 90 minutes and then final cured at about 120° C. for about 12 hours. The substrates were stored at about 45% relative humidity for four days before being tested.

Test Procedure I

Test Procedure I was designed to measure the cut rate of the grinding disc and the amount of metal removed in twelve minutes. The disc was mounted on a beveled aluminum backup pad, and used to grind the face of a 1.25 centimeter by 18 centimeters 1018 mild steel work piece. The disc was driven at about 5,500 revolutions per minute while the portion of the disc overlaying the beveled edge of the backup pad contracted the work piece at about a 6 kilograms load. Each disc was used to grind a separate work piece for a one minute integral for a total time of twelve minutes. The total cut was the summation of the amount of stock removed from the work piece throughout the duration of the test. The performance of the disc construction was stated as percent of control, that is the total amount of metal removed for the control example was equated to 100% and the examples were measured relative to the control example.

Examples 1–6 and Comparative Examples A. B. and C

For Examples 1 through 6 and Comparative Example A, B, and C, the mineral used was a grade 36 co-fused alumina-zirconia grain, available from Norton Company, Worcester, Massachusetts. Table 1 lists the constructions for Example 1 through 6, Table 2 lists the mineral and resin weights for the discs, and Table 3 reports the results from Test Procedure I. (Comparative Example A was the control example in Table 3).

Comparative Example A

Comparative Example A was prepared according to the General Preparation Procedure set forth above. A flat thermoplastic reinforced backing having no raised portions was used.

Comparative Example B

Comparative Example B was a grade 36 disc with no raised portions commercially available from Bates Abrasive Products, Inc., Chicago Ill., under the trade designation "Marvel".

Comparative Example C

Comparative Example C was prepared according to the General Preparation Procedure set forth above, except that a flat vulcanized fibre backing, about 0.76 millimeters thick, having no raised portions was used.

Examples 1–6

The discs for Examples 1 through 6 were prepared according to the General Preparation Procedure set forth above. The diameter of the raised portions and the number of raised portions are listed in Table 1 below. The raised portions were arranged circumferentially around the perimeter of each disc. Table 2 lists the resin and mineral weights for each disc.

Examples 1 through 6 were tested according to Test Procedure I and the results are listed in Table 3.

TABLE 1

| Ex. No.* | Raised Portion Diameter (centi-meters) | Raised Portion Height (milli-meters) | No. Rows | Total # Raised Portions |
|---|---|---|---|---|
| 1 | 1.27 | 0.76 | 2 | 55 |
| 2 | 1.27 | 0.76 | 3 | 88 |
| 3 | 1.27 | 0.51 | 3 | 88 |
| 4 | 1.91 | 0.76 | 2 | 40 |

TABLE 1-continued

| Ex. No.* | Raised Portion Diameter (centi-meters) | Raised Portion Height (milli-meters) | No. Rows | Total # Raised Portions |
|---|---|---|---|---|
| 5 | 1.27 | 0.76 | 2 | 55 |
| 6 | 2.54 | 0.76 | 2 | 28 |

*Examples 1 and 5 were the same construction.

TABLE 2

| Example | Make coat wt. (grams) | Mineral wt. (grams) | Size wt. (grams) |
|---|---|---|---|
| 1 | 1.2 | 9.0 | 8.0 |
| 2 | 1.8 | 13.0 | 10.0 |
| 3 | 2.1 | 13.0 | 10.0 |
| 4 | 2.2 | 13.5 | 12.3 |
| 5 | 1.6 | 10.0 | 7.3 |
| 6 | 2.3 | 16.0 | 13.6 |
| Comp. A | 5.1 | 26.0 | 15.0 |
| Comp. C | 5.0 | 25.0 | 11.7 |

TABLE 3

| Example | Total Cut (grams) | Total Cut (%) |
|---|---|---|
| 1 | 651* | 105* |
| 2 | 532 | 86 |
| 3 | 614 | 99 |
| 4 | 574 | 93 |
| 5 | 522* | 84* |
| 6 | 620 | 100 |
| Comp. A | 620 | 100 |
| Comp. B | 616 | 99 |
| Comp. C | 717 | 116 |

*Examples 1 and 5 were tested for only 2 minutes. The values listed in Table 3 for Examples 1 and 5 have been multiplied by 5.

A review of Tables 1, 2 and 3 reveals that Examples 1–6, prepared in accordance with the present invention, utilized, by weight, less make coat, less abrasives and less size resin (in some cases, the examples used less than half) than the comparative examples while still maintaining approximately between 84% and 105% of the cut. For instance, the make coat, abrasives and size resin of Example 2 had a weight 56% that of comparative A while cutting 86% of the total cut as that of Comparative A. Additionally, Example 6 had a weight 72% of Comparative A while cutting the approximate same amount as Comparative A.

From the tests conducted, a disc prepared according to the present invention performed substantially the same amount of cutting while utilizing less material. The less material equates into a substantial cost savings.

Example 7 and Comparative Examples D and E

For Example 7 and Comparative Examples D and E, the mineral used was a grade 50 sol gel alumina abrasive grain, available from Minnesota Mining and Manufacturing Company, St. Paul, Minn., under the trade designation "Cubitron 201".

Comparative Example D

Comparative Example D was a grade 50 disc commercially available from 3M Company, St. Paul, Minn., under the trade designation "Regal Resin Bond" fibre disc, number 3M983C.

Comparative Example E

Comparative Example E was made according to the General Preparation Procedure set forth above with grade 50 mineral on a 0.76 mm thick vulcanized fibre backing having no raised portions thereon. The weight of the make coat was about 1.6 grams, mineral was about 10 grams, and the size resin was about 5 to 6 grams per disc.

Example 7

Example 7 was prepared according to the General Preparation Procedure set forth above. The diameter of the raised portions were about 2.2 centimeters in diameter, and were spaced circumferential around the perimeter of the disc. There were 29 raised portions on the disc. The weight of the make coat was about 1.6 grams, mineral was about 10 grams, and the size resin was about 5 to 6 grams per disc.

TABLE 4

| Example | Total Cut (grams) | Time Endpoint (minutes) |
|---|---|---|
| 7 | 744 | 15 |
| Comparative D | 442 | 12 |
| Comparative E | 671 | 15 |

In the Example 7 test, while the surface area of the raised portions were only 41.6% of the ground area of the conventional discs (Comparative D and Comparative E), a review of Table 4 reveals that the amount of product cut by Example 7 is actually greater than the amounts cut by either Comparative D or Comparative E. In fact, Example 7 cut 111% more than Comparative E to a equal time endpoint. The initial cut rate for Example 7 was 73.6 grams/min, for Comparative Example D was 77.3, and for Comparative E was 79.6 grams/min. However, surprisingly, the final cut rate for Example 7 was approximately 32.2 grams/minute versus the cut rate for Comparative D and Comparative E of approximately 7.1 grams/minute and approximately 14.0 grams per minute, respectively. Therefore, a disc according to the present invention with raised portions as described above actually cuts more product with less raw material used in the manufacture of the disc than the grinding discs currently used on the market.

A disc 10 according to the present invention has numerous other advantages over the grinding discs currently used. For instance, the disc 10 of the present invention offers improved flexibility and may eliminate the need for final flexing. Furthermore, once the raised portions 20 on the disc 10 have worn down through use, the remaining part of the raised portions 20 can be removed from the disc 10. Then, the disc 10 can be recoated with abrasive material thereby recycling the disc 10 for further use without the need for excessive additional material.

Although the present invention has been described with reference to preferred embodiments, workers skilled in the art will recognize that changes may be made in form and detail without departing from the spirit and scope of the invention.

What is claimed is:

1. A coated abrasive article having a patterned abrasive surface, the article comprising:

a substrate having a periphery, a first side and a second side opposite said first side and comprising a thermoplastic material;

said first side having a plurality of raised portions suitable for the application of an abrasive coating thereon, and recessed areas extending around said periphery on said first side and between said raised portions, said second side being substantially planar;

a first adhesive layer applied to said raised portions; and an abrasive material deposited onto said first adhesive layer thereby coating said raised portions to form an abrasive coating, said recessed areas remaining substantially free of said abrasive material.

2. The article as claimed in claim 1 wherein the substrate further includes an effective amount of a fibrous reinforcing material imparting heat resistance, toughness, flexibility and shape control to said substrate, said thermoplastic material and said reinforcing material comprising a hardened composition capable of withstanding temperatures of at least about 200° C. during abrasive applications without substantial deformation or disintegration, said fibrous reinforcing material making up about 1% to about 40% of the weight of said substrate, said reinforcing material selected from the group consisting of metallic fibers and nonmetallic fibers.

3. The article as claimed in claim 2 wherein said nonmetallic fibers are selected from the group consisting of glass fiber, carbon fiber, mineral fiber, synthetic or natural fiber formed of heat resistant organic material, ceramic fiber, and combinations thereof.

4. The article as claimed in claim 3 wherein said natural fiber is selected from the group consisting of wool, silk, cotton, cellulose, and combinations thereof.

5. The article as claimed in claim 3 wherein said synthetic fiber is selected from the group consisting of polyvinyl alcohol fiber, polyester fiber, rayon fiber, polyamide fiber, acrylic fiber, aramid fiber, phenolic fiber, and combinations thereof.

6. The article as claimed in claim 1 wherein each raised portion is comprised of the same thermoplastic material as the substrate.

7. The article as claimed in claim 1 wherein each of the raised portions has a geometric shape selected from the group consisting of a circle, an ellipse, a rectangle, a triangle, lines, and swirls.

8. The article as claimed in claim 1 wherein each raised portion has a height between approximately 0.05 millimeter and approximately 10 millimeters.

9. The article as claimed in claim 8 wherein the height of each raised portion is approximately 5 millimeters.

10. The article as claimed in claim 1 wherein certain raised portions have variable widths and wherein the width at a narrowest point is between approximately 0.1 centimeter and approximately 5 centimeters.

11. The article as claimed in claim 1 wherein the substrate has a radius, a center and a periphery.

12. The article as claimed in claim 11 wherein each raised portion has a geometric shape selected from the group consisting of a line and a swirl having a length, and the length of the geometric shape is approximately equal to the radius of the disc.

13. The article as claimed in claim 11 wherein the raised portions are arranged on the substrate as at least one concentric circle between said periphery and said center.

14. The article as claimed in claim 11 wherein the raised portions are arranged on the substrate as at least one radial arm extending between said center of the disc and said periphery of the disc.

15. The article as claimed in claim 1 and further including a second adhesive layer applied over the abrasive coating to securely anchor the abrasive material to the substrate.

16. The article as claimed in claim 1 wherein said substrate further comprises an effective amount of a toughening agent selected from the group consisting of toluene sulfonamide derivatives; styrene butadiene copolymers; polyether backbone polyamides; rubber-polyamide copolymers; functionalized triblock polymers of styrene-(ethylene butylene)-styrene; and mixtures of these materials.

17. The article as claimed in claim 1 wherein said thermoplastic material is selected from the group consisting of polycarbonates, polyetherimides, polyesters, polysulfones, polystyrenes, acrylonitrile-butadiene-styrene block copolymers, acetal polymers, polyamides, and combinations thereof.

18. The article as claimed in claim 1 wherein each of said raised portions include a distal end extending above said recessed areas to form a plurality of substantially co-planar grinding surfaces.

19. A method of making a coated abrasive article, the method comprising:

providing a substrate comprising a thermoplastic material, said substrate having a periphery, a first side and a second side opposite said first side;

forming raised portions in said first side of said substrate so that said first side consists of said raised portions suitable for the application of an abrasive coating thereon with recessed areas extending around said periphery on said first side and between said raised portions and said second side consists of a substantially planar surface;

applying an adhesive layer onto said raised portions, said raised portions providing a means for said adhesive layer to be applied uniformly; and depositing an abrasive material on the first adhesive layer thereby coating the raised portions of the substrate, the recessed areas remaining substantially free of the abrasive material deposit.

20. The method as claimed in claim 19 wherein the article is in the form of a disc and further including arranging the raised portions in at least one concentric circle between the periphery and the center of the substrate.

21. The method as claimed in claim 19 wherein the article is in the form of a disc and further including arranging the raised portions in at least one radial arm extending between a center of the substrate and a periphery of the substrate.

22. The method as claimed in claim 19 wherein said providing comprises incorporating an effective amount of a fibrous reinforcing material into said thermoplastic material, said thermoplastic and said reinforcing material forming a hardened composition capable of withstanding temperatures of at least about 200° C. during abrasive applications without substantial deformation or disintegration, said reinforcing material selected from the group of nonmetallic fibers consisting of glass fiber, carbon fiber, mineral fiber, synthetic or natural fiber formed of heat resistant organic material, ceramic fiber, and combinations thereof.

23. The method as claimed in claim 22 wherein said natural fiber is selected from the group consisting of wool, silk, cotton, cellulose, and combinations thereof.

24. The method as claimed in claim 22 wherein said synthetic fiber is selected from the group consisting of polyvinyl alcohol fiber, polyester fiber, rayon fiber, polyamide fiber, acrylic fiber, aramid fiber, phenolic fiber, and combinations thereof.

25. The method as claimed in claim 19 wherein said providing further comprises including an effective amount of a toughening agent within said substrate, said toughening agent selected from the group consisting of toluene sulfonamide derivatives, styrene butadiene copolymers, polyether backbone polyamides, rubber-polyamide copolymers, functionalized triblock polymers of styrene-(ethylene butylene)-styrene, and mixtures of these materials.

26. The method as claimed in claim 19 wherein said providing comprises selecting said thermoplastic material from the group consisting of polycarbonates, polyetherimides, polyesters, polysulfones, polystyrenes, acrylonitrile-butadiene-styrene block copolymers, acetal polymers, polyamides, and combinations thereof.

27. The method as claimed in claim 19 wherein said forming further comprises forming each of said raised portions to include a distal end extending above said recessed areas to form a plurality of substantially co-planar surfaces suitable for the application of an abrasive coating thereon.

* * * * *

UNITED STATES PATENT AND TRADEMARK OFFICE

CERTIFICATE OF CORRECTION

PATENT NO. : 6,371,842 B1
DATED : April 16, 2002
INVENTOR(S) : Romero, Vincent D.

It is certified that error appears in the above-identified patent and that said Letters Patent is hereby corrected as shown below:

Column 3,
Line 49, “IN” should read -- In --.
Line 56, “sutiable” should read -- suitable --.

Column 4,
Line 19, “appliedover” should read -- applied over --.
Line 22, “oder” should read -- order --.
Line 24, “elctron” should read -- electron --.

Signed and Sealed this

Seventeenth Day of June, 2003

JAMES E. ROGAN
*Director of the United States Patent and Trademark Office*